United States Patent [19]

Lalvani

[11] Patent Number: 4,620,998

[45] Date of Patent: Nov. 4, 1986

[54] CRESCENT-SHAPED POLYGONAL TILES

[76] Inventor: Haresh Lalvani, 317 Washington Ave., Apt. 4A, Brooklyn, N.Y. 11205

[21] Appl. No.: 698,534

[22] Filed: Feb. 5, 1985

[51] Int. Cl.[4] ..... B44C 1/28; B44F 11/04

[52] U.S. Cl. ..... 428/33; D25/80; 52/311; 273/157 R; 428/47; 428/80

[58] Field of Search ..... D25/80; 273/157 R; 434/96; 52/311; 428/33, 47, 48, 49, 80, 542.8

[56] References Cited

U.S. PATENT DOCUMENTS

| | | | |
|---|---|---|---|
| 613,333 | 11/1898 | Thomas | 52/311 |
| 1,474,779 | 11/1923 | Kammer | 52/608 X |
| 1,630,530 | 5/1927 | Fryer | 273/157 R |
| 1,838,108 | 12/1931 | Rhodes | 428/80 |
| 3,590,719 | 7/1971 | Lambert | 98/40.16 |
| 3,921,312 | 11/1975 | Fuller | 434/96 |
| 3,981,505 | 9/1976 | Odier | 273/157 R |
| 4,113,256 | 9/1978 | Hutchings | 428/47 X |
| 4,133,152 | 1/1979 | Penrose | 428/47 X |
| 4,223,890 | 9/1980 | Schoen | 428/51 X |
| 4,343,471 | 8/1982 | Calvert | 428/47 X |
| 4,350,341 | 9/1982 | Wallace | 428/47 X |
| 4,503,654 | 3/1985 | Cosentino | 428/49 X |
| 4,537,001 | 8/1985 | Uppstrom | 428/33 X |

OTHER PUBLICATIONS

MacMahon, New Mathematical Pastimes, 1921, Cambridge at the University Press, pp. 50–59.

M. Gubeli, Pentalbi Game, [date unknown], distributed by Kurt Naef.

Martin Gardner, Theory of Tiles, Scientific American, Jan. 1977, pp. 110–121, 132.

*Primary Examiner*—Henry F. Epstein

*Attorney, Agent, or Firm*—Roylance, Abrams, Berdo & Goodman

[57] ABSTRACT

Crescent-shaped, polygonal tiles useful for covering walls, floors, ceilings, streets or paths and for producing toys, games and structures. The tiles each have a substantially convex outer edge, a substantially concave inner edge, and at least seven sides forming the edges. In some instances, these sides are straight and of equal length, and in other instances they are not straight but enclose the same area as enclosed by the straight sides of equal length. The tiles, either by themselves or in combination with others, interconnect to fill a plane. Either by themselves or in combination with others, the tiles form mosaics with periodic or non-periodic patterns.

6 Claims, 15 Drawing Figures

CRESCENT-SHAPED POLYGONAL TILES

FIELD OF THE INVENTION

The invention relates to crescent-shaped polygonal tiles forming a mosaic, or tessellation, for covering walls, floors, ceilings, streets or paths, and for producing toys, games and structures. The tiles each having a substantially convex outer edge, a substantially concave inner edge, and at least seven sides forming the edges. In some instances, these sides are straight and of equal length, and in other instances these sides are not straight but enclose the same area as enclosed by the straight sides of equal length.

BACKGROUND OF THE INVENTION

Various tiling systems are known for creating a mosaic, or tessellation, for covering walls, floors, ceilings, streets or paths and also for producing toys, games and various structures. Usually these tiles are formed from simple polygons such as triangles, squares, rectangles, and octagons, which results in a plane-filling pattern that repeats, i.e, is periodic. These systems, while functional and easy to install, result in a somewhat boring and predictable pattern.

In addition, other tiling systems are known which do not use simple polygons; however, many of these also provide a periodic pattern and some of these are incapable of completely filling a plane, i.e., there are gaps in between various sets.

Examples of these prior systems are disclosed in the following U.S. Pat. Nos.: 3,921,312 to Fuller; 3,981,505 to Odier; 4,133,152 to Penrose; 4,223,890 to Schoen; 4,343,471 to Calvert; and 4,350,341 to Wallace. A further example of such a system is disclosed in New Mathematical Pastimes by MacMahon, 1921, Cambridge at the University Press, pages 50–59.

SUMMARY OF THE INVENTION

Accordingly, a primary object of the invention is to provide a tiling system comprised of a polygonal tile that is capable of covering a plane without interruption and can provide a non-periodic pattern.

Another object of the invention is to provide a tiling system in which crescent-shaped polygonal tiles form a mosaic, each tile having a substantially convex outer edge, a substantially inner edge, and at least seven straight sides of equal length forming the edges or at least seven sides which are not straight but enclose the same area as enclosed by the straight sides.

A further object of the invention is to provide a tiling system in which the tiles, either by themselves or in combination with others, form mosaics with periodically or non-periodically repeating patterns.

The foregoing objects are basically attained by providing a polygonal tile of greater than six sides comprising a substantially crescent-shaped body member having an outer edge directly interconnected with an inner edge, the outer and inner edges each being formed from p straight sides having equal length, the outer edge being substantially convex, the inner edge being substantially concave, adjacent ones of the outer edge sides each being oriented at an interior angle V, and adjacent ones of the inner edge sides each being oriented at an exterior angle V.

The straight sides of the polygonal tile can be selected from the group consisting of any number greater than six. The interior angles of the outer edge are the same as the exterior angles of the inner edge, these angles being 180° (1–2/p). In addition, the outer edge sides are each oriented at an exterior angle equal to 360° minus the corresponding interior angle, and the inner edge sides are each oriented at an interior angle equal to 360° minus the corresponding exterior angle.

Rather than using straight sides, the tiles can have sides that are not straight but nonetheless enclose the same area as enclosed by the straight sides of equal length.

Other objects, advantages, and salient features of the present invention will become apparent from the following detailed description, which, taken in conjunction with the annexed drawings, discloses preferred embodiments of the invention.

DRAWINGS

Referring now to the drawings which form a part of this original disclosure:

DETAILED DESCRIPTION OF THE INVENTION

Figure 1:
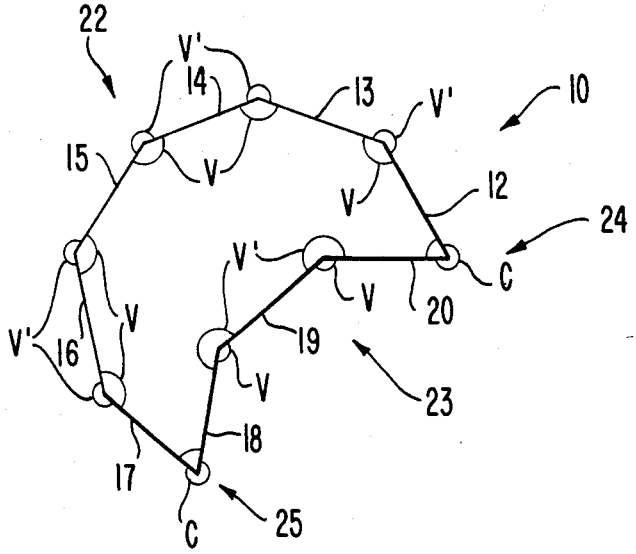
FIG. 1 is a top plan view of a crescent-shaped tile in accordance with the invention comprising nine sides including three on the inner edge and six on the outer edge.

As seen in FIG. 1, a tile 10 in accordance with the invention is shown in top plan view and by way of example it has nine straight sides 12–20. It is contemplated that a tile having greater than six straight sides can be used to fill a plane and provide either by itself or in combination with other tiles of mosaic with a non-periodic pattern. The tile 10 can be of any physical size desired and any depth. It can also be formed of any desirable material and have any desired pattern formed thereon.

The tile 10 as seen in FIG. 1 is polygonal and forms a substantially crescent-shaped body member having an outer edge 22 formed by sides 12–17 and an inner edge 23 formed by sides 18–20. The outer and inner edges are respectively substantially convex and concave and are directly interconnected at a first crescent angle 24 and a second crescent angle 25 so that they form a complete continuous enclosure.

As seen in FIG. 1, the adjacent outer edge sides are each oriented at an interior angle V which is the same and is also equal to the exterior angle V formed by adjacent inner edge sides. Likewise, each exterior angle V′ formed by adjacent sides on the outer edge is equal to one another and equal to the interior angles V′ formed by the adjacent sides on the inner edge. In this regard, if "p" designates the number of sides in the tile, then the interior and exterior angles V equal 180° (1–2/p). Likewise, the exterior angle V′ between the sides on the outer edge is equal to 360°-V and the interior angle V′ between the inner edge sides is equal to 360°-V. Another way of saying this is that these opposite angles are complements such that the sum of the adjacent interior and exterior angles are equal to 360° or the interior angle V′ equals 180° (1+2/p). This is also true for the exterior angles on the outer edge.

Figure 2:
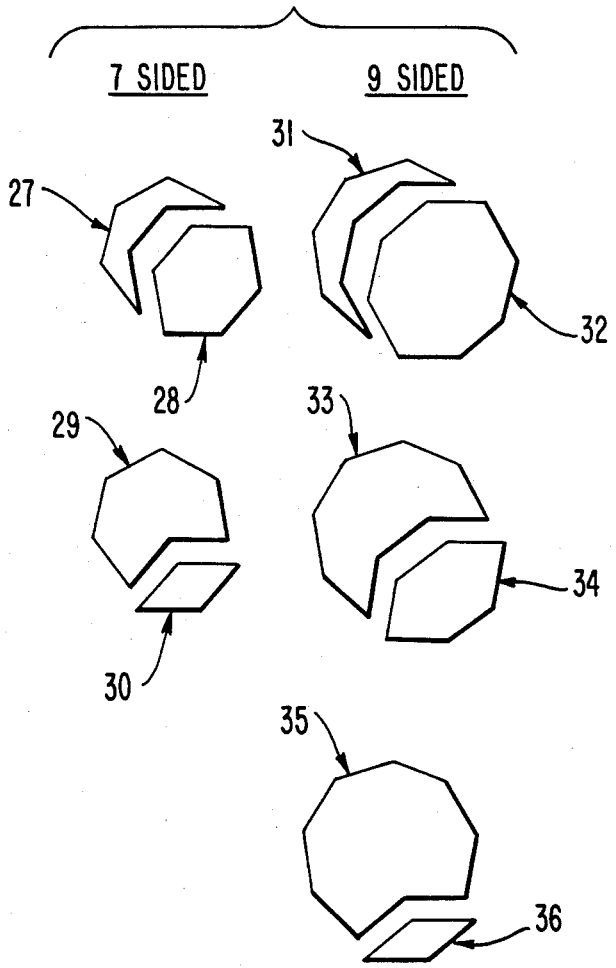
FIG. 2 is a group of odd number sided tiles including seven-sided with inner edge sides numbering three and two, and nine-sided with inner edge sides numbering four, three and two.
Figure 3:
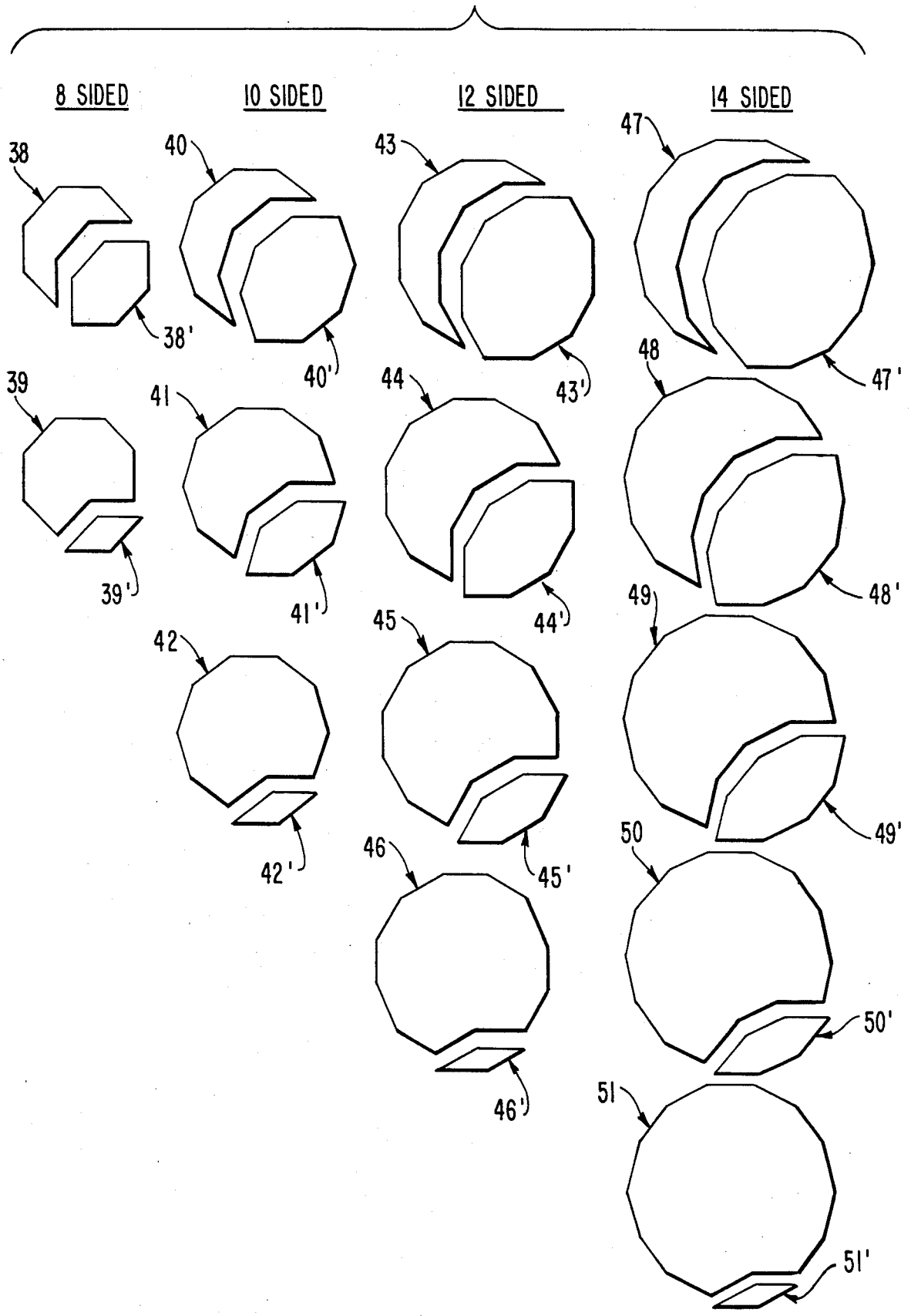
FIG. 3 is a group of even number sided tiles including eight-sided with inner edge sides numbering three and two; 10-sided with inner edge sides numbering four, three and two; 12-sided with inner edge sides numbering five, four, three and two; and 14-sided with inner edge sides numbering six, five, four, three and two.

As is evident from viewing FIGS. 2 and 3, each of the crescent-shaped polygonal tiles are formed as portions of a complete and regular polygon, and both the outer and inner interior angles are multiples of the central angle F of the regular polygon, these angles being different for odd number sided and even number sided crescent-shaped tiles. Thus, for even-sided tiles V/F equals $\frac{1}{2}$ (p-2) and V′/F equals $\frac{1}{2}$(p+2). For odd-sided tiles V/$\frac{1}{2}$F equals p−2 and V′/$\frac{1}{2}$F equals p+2. This ratio is always a whole number and thus V/F+V′/F equals p for even-sided tiles and V/$\frac{1}{2}$F+V′/$\frac{1}{2}$F equals 2p for odd-sided crescent tiles. All interior angles on the inner and outer edges of p-sided crescent tiles can be derived by multiplying this ratio by half the central angle of the regular p-sided polygon for odd sides and by the central angle for even-sided regular polygons.

As seen in FIG. 2, there is illustrated a group of odd number sided tiles including a seven-sided tile 27 with the remaining portion 28 of the regular polygon from which tile 27 was derived, tile 27 having three inner edge sides. A second seven-sided tile 29 is illustrated with the remaining portion 30 of the regular polygon from which it was derived, tile 29 having an inner edge including two sides. In addition, FIG. 2 shows a nine-sided tile 31, the remaining portion 32 of the polygon from which it was derived; a nine-sided tile 33, and the remaining portion 34 of the polygon from which it was derived; and a nine-sided tile 35 and the remaining portion 36 of the polygon from which it was derived. As is evident, tile 31 has four sides on its inner edge, tile 33 has three, and tile 35 has two.

As seen in FIG. 3, tiles having an even number of sides are shown including two eight-sides tiles 38 and 39, three 10-sided tiles 40–42, four 12-sided tiles 43–46 and five 14-sided tiles 47–51, the remaining portion of the polygon from which each of the tiles was derived being shown and provided with a reference numeral corresponding to the tile's reference numeral plus a prime.

Referring again to FIG. 1, the number of crescent angles C (shown at 24 and 25), and thus crescent points, in the tile is always two. The crescent angle is also related to the central angle F of the regular polygon from which the crescent-shaped tile is derived and is different for even and odd-sided tiles. The ratio of the crescent angle to the central angle is a whole number and for even-sided crescents, it is equal to C/F, while for odd-sided tiles, it is equal to C/$\frac{1}{2}$F.

Moreover, the sum of the interior angles of the crescent-shaped tile is the same as the sum of the interior angles of its regular polygon, and there are always more sides in the outer edge than in the inner edge.

As shown in FIG. 1, p equals 9, the interior crescent angles C are 60°, the interior angles V on the outer edge and the exterior angles V on the inner edge are 140°, the complementary angles V′ are 220°, there are three inner edge sides, six outer edge sides and the central angle F is 40°.

As illustrated in FIGS. 4–15, the crescent-shaped tiles in accordance with the invention have the extraordinary property of completely filling a plane non-periodically. This is due to the proportions of the angles, all of which are in simple whole number relations with each other. Thus, the requirement for covering a plane is that the sum at every vertex of the tiling must add to 360°, and this is accomplished as illustrated in FIGS. 4–15. While only several illustrations have been shown, it is clear that numerous other tiles in accordance with the invention can completely fill a plane and repeat non-periodically. In addition, some of the tiles also fill a plane periodically.

Figure 4:
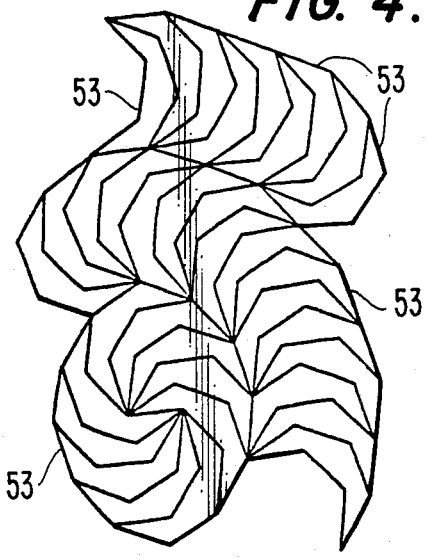
FIG. 4 is a non-periodic mosaic of seven-sided tiles, each having three inner edge sides.

By way of example, as seen in FIG. 4, there is a non-periodic plane-filling mosaic of seven-sided tiles 53, each having three inner edge sides.

Figure 5:
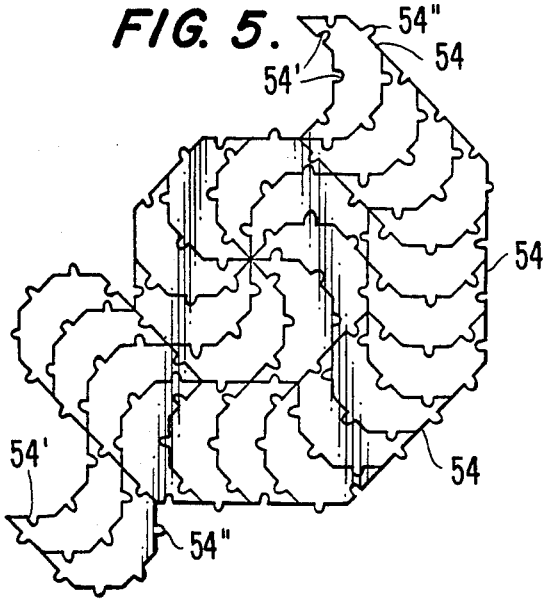
FIG. 5 is a non-periodic mosaic of eight-sided tiles, each having three inner edge sides, the sides not being straight.

In FIG. 5, there is a non-periodic mosaic of eight-sided tiles 54, each having three inner edge sides. As illustrated, the eight sides of tiles 54 are not straight but are interrupted by recesses 54′ in some sides and by tongues 54″ in other sides. Since the total area A enclosed by the sides of tile 54 is the same as it would have been were the recesses and tongues not formed (i.e., the sides remained equal and straight), the tiles still interconnect and fill a plane.

Figure 6:
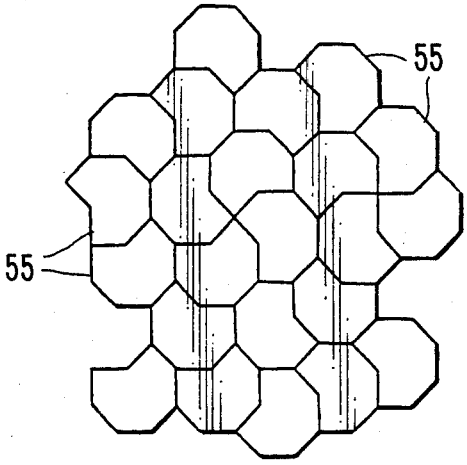
FIG. 6 is a non-periodic mosaic of eight-sided tiles, each having two inner edge sides.

In FIG. 6, there is a non-periodic mosaic of eight-sided tiles 55, each having two inner edge sides.

Figure 7:
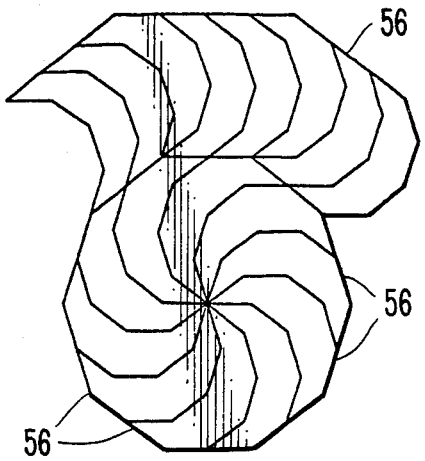
FIG. 7 is a non-periodic mosaic of 10-sided tiles, each having four inner edge sides.

In FIG. 7, there is a non-periodic mosaic of 10-sided tiles 56, each having four inner edge sides.

Figure 8:
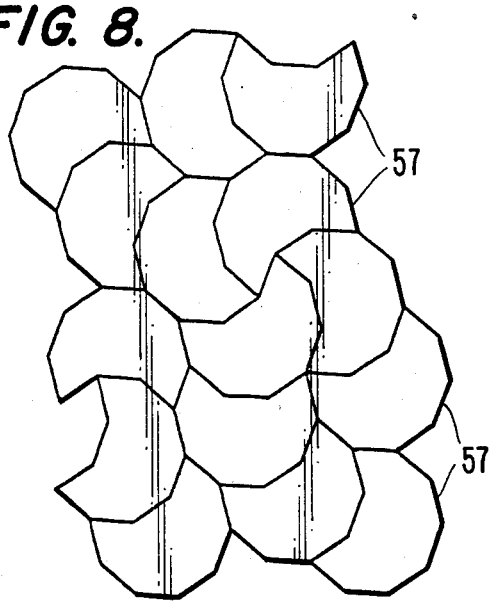
FIG. 8 is a non-periodic mosaic of 10-sided tiles; each having three inner edge sides.

In FIG. 8, there is a non-periodic mosaic of 10-sided tiles 57, each having three inner edge sides.

Figure 9:
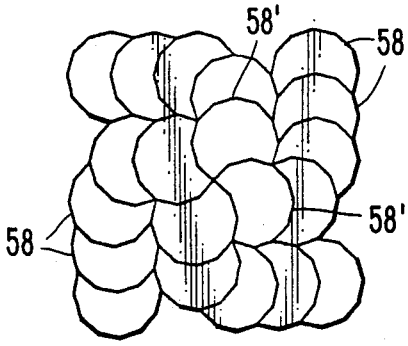
FIG. 9 is a non-periodic mosaic of two sets of 12-sided tiles, one having four inner edge sides, and the other having three inner edge sides.
Figure 10:
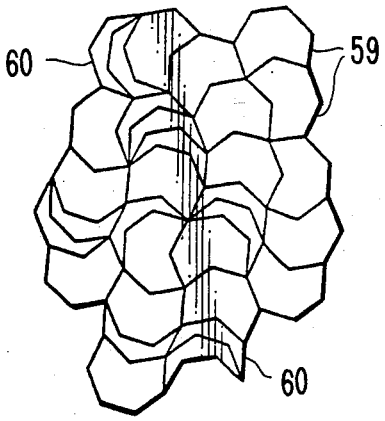
FIG. 10 is a non-periodic mosaic of two sets of seven-sided tiles, one set having two inner edge sides and the other having three inner edge sides.

In FIG. 9, there is a non-periodic mosaic of two sets of 12-sided tiles 58 and 58′, 58 having four inner edge sides and 58′ having three inner edge sides.

By way of example, as illustrated in FIGS. 10–15, various sets of different sided tiles can be combined to provide a non-periodic mosaic that fills a plane. Thus, in FIG. 10, there are two sets of seven-sided tiles including tiles 59 having two inner edge sides, and tiles 60 having three inner edge sides.

Figure 11:
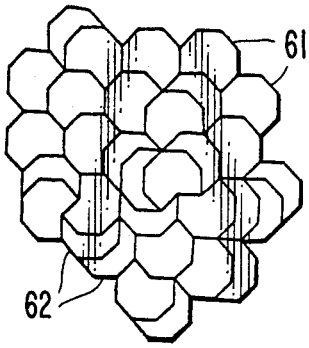
FIG. 11 is a non-periodic mosaic of two sets of eight-sided tiles, one set having two inner edge sides and the other having three inner edge sides.

In FIG. 11, there are two sets of eight-sided tiles, tiles 61 having two inner edge sides, and tiles 62 having three inner edge sides.

Figure 12:
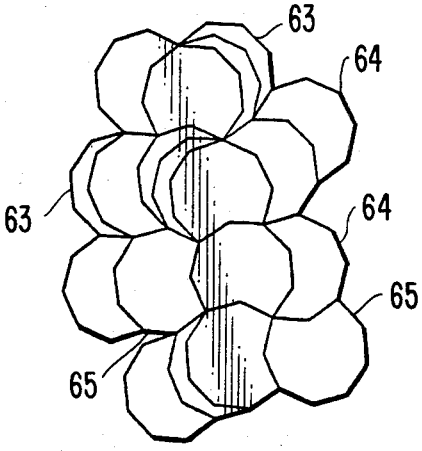
FIG. 12 is a non-periodic mosaic of three sets of nine-sided tiles, one set having four inner edge sides, a second set having three inner edge sides, and the third two inner edge sides.

In FIG. 12, there are three sets of nine sided tiles, tiles 63 having four inner edge sides, tiles 64 having three inner edge sides, and tiles 65 having two inner edge sides.

Figure 13:
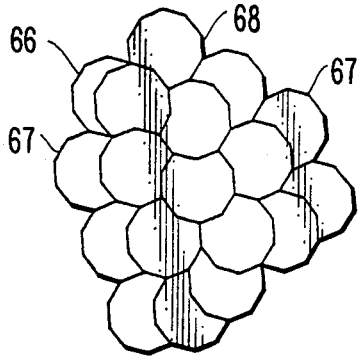
FIG. 13 is a non-periodic mosaic of three sets of 10-sided tiles, one set having four inner edge sides, a second set having three inner edge sides, and the third two inner edge sides.

In FIG. 13, there are three sets of 10-sided tiles, tiles 66 having four inner edge sides, tiles 67 having three inner edge sides, and tiles 68 having two inner edge sides.

Figure 14:
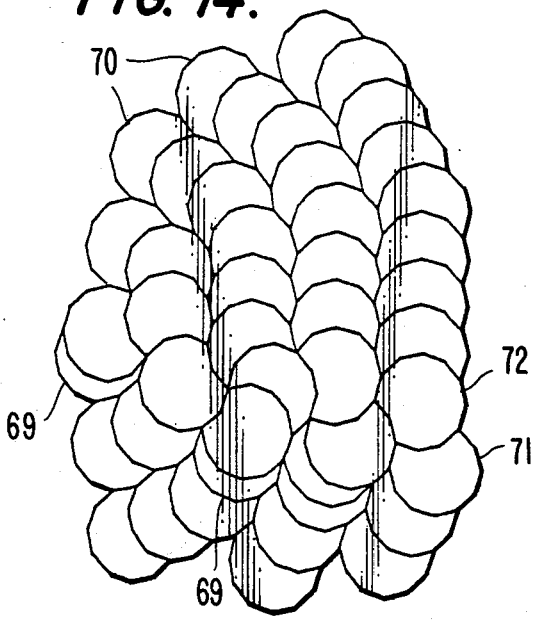
FIG. 14 is a non-periodic mosaic of four sets of 12-sided tiles, one set having five inner edge sides, a second having four, a third having three and a fourth having two.

In FIG. 14, there are four sets of 12 sided tiles, tiles 69 having five inner edge sides, tiles 70 having four, tiles 71 having three, and tiles 72 having two.

Figure 15:
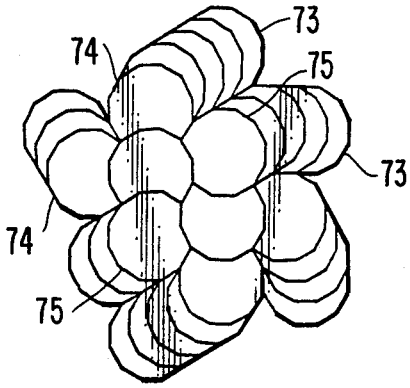
FIG. 15 is a non-periodic mosaic of three sets of 12-sided tiles, one set having two inner edge sides, second having three inner edge sides, and the third having five inner edge sides.

Finally, in FIG. 15, there are two sets of 12-sided tiles, tiles 73 having five inner edge sides, tiles 74 having three, and tiles 75 having two.

While various advantageous embodiments have been chosen to illustrate the invention, it will be understood by those skilled in the art that various changes and modifications can be made therein without departing from the scope of the invention as defined in the appended claims. For example, the tiles can be interconnected to form a continuous surface in plan view, which actually has different heights in elevational view, or stacked on top of each other in layers of differing numbers of tiles.

What is claimed is:

1. A system of plane-filling polygonal tiles, the combination comprising:

a plurality of tiles interconnected to form a continuous surface and to form a non-periodic mosaic, each of said tiles having greater than six sides and including a substantially crescent-shaped body member having an outer edge directly interconnected with an inner edge, said outer and inner edges each being formed from p straight sides having equal length, said outer edge being substantially convex, said inner edge being substantially concave, adjacent ones of said outer edge sides each being oriented at an interior angle V, and adjacent ones of said inner edge sides each being oriented at an exterior angle V, the number of sides p being selected from the group consisting of the even numbers greater than six.

2. A polygonal tile according to claim 1, wherein said interior angles V equal 180° $(1-2/p)$, and said exterior angles V equal 180° $(1-2/p)$.

3. A polygonal tile according to claim 2, wherein adjacent ones of said outer edge sides are each oriented at an exterior angle equal to 360°-V, and adjacent ones of said inner edge sides are each oriented at an interior angle equal to 360°-V.

4. A system of plane-filling polygonal tiles, the combination comprising:

a plurality of tiles interconnected to form a continuous surface and to form a non-periodic mosaic, each of said tiles having greater than six sides and including a body member having an outer edge directly interconnected with an inner edge, said outer and inner edges each being formed from a plurality of sides, and said outer and inner edges combining to define an area A therebetween, said area A being equal to the area defined by outer and inner edges having straight sides p of equal length with said outer edge being substantially convex, said inner edge being substantially concave, adjacent ones of said outer edge sides being oriented at an interior angle V and adjacent ones of said inner edge sides being oriented at an exterior angle V, the number of sides p being selected from the group consisting of the even numbers greater than six.

5. A system of plane-filling polygonal tiles, the combination comprising:

a plurality of tiles interconnected to form a continuous surface and to form a non-periodic mosaic, each of said tiles having greater than six sides and including a substantially crescent-shaped body member having an outer edge directly interconnected with an inner edge, said outer and inner edges each being formed from p straight sides having equal length, said outer edge being substantially convex, said inner edge being substantially concave, adjacent ones of said outer edge sides each being oriented at an interior angle V, and adjacent ones of said inner edge sides each being oriented at an exterior angle V, the number of sides p being selected from the group consisting of the odd numbers greater than five.

6. A system of plane-filling polygonal tiles, the combination comprising:

a plurality of tiles interconnected to form a continuous surface and to form a non-periodic mosaic.

each of said tiles having greater than six sides and including a body member having an outer edge directly interconnected with an inner edge, said outer and inner edges each being formed from a plurality of sides, and said outer and inner edges combining to define an area A therebetween, said area A being equal to the area defined by outer and inner edges having straight sides p of equal length with said outer edge being substantially convex, said inner edge being substantially concave, adjacent ones of said outer edge sides being oriented at an interior angle V and adjacent ones of said inner edge sides being oriented at an exterior angle V, the number of sides p being selected from the group consisting of the odd numbers greater than five.

* * * * *